United States Patent [19]

Baron

[11] Patent Number: 4,489,776

[45] Date of Patent: Dec. 25, 1984

[54] HEAT EXCHANGER WITH TUBE CLEANING ELEMENT CAPTURING CAGE INTERCONNECTION

[75] Inventor: Walter J. Baron, Milwaukee, Wis.

[73] Assignee: Water Services of America, Inc., Milwaukee, Wis.

[21] Appl. No.: 516,696

[22] Filed: Jul. 21, 1983

[51] Int. Cl.[3] ..... F28G 1/12

[52] U.S. Cl. ..... 165/95; 15/3.51

[58] Field of Search ..... 15/3.51, 104.06 R; 137/15, 242, 244; 165/95, 175

[56] References Cited

U.S. PATENT DOCUMENTS

| | | | |
|---|---|---|---|
| 3,319,710 | 5/1967 | Heeren et al. | 165/95 |
| 4,124,065 | 11/1978 | Leitner et al. | 165/95 |
| 4,353,414 | 10/1982 | Leitner | 165/95 |
| 4,382,465 | 5/1983 | Baron et al. | 165/95 |
| 4,397,349 | 8/1983 | Baron et al. | 165/95 |

*Primary Examiner*—Stephen F. Husar

*Attorney, Agent, or Firm*—Andrus, Sceales, Starke & Sawall

[57] ABSTRACT

A heat exchanger has a plurality of fluid flow tubes secured adjacent their ends by tube sheets. Cleaning elements, such as brushes, are adapted to shuttle back and forth in the tubes. Cleaning element capturing cages or baskets are mounted to the tube ends. When the tube ends are of varying diameters along the plane of a tube sheet, some baskets are press fit into the larger diameter tube ends and an adhesive used to rigidly secure the members together, as heretofore. In addition, other baskets are loosely slipped over the smaller diameter tube ends. However, an adhesive is not necessary to rigidly fix these latter baskets in place. Instead, a connector device joins baskets which are not rigidly fixed against axial movement to those that are, so that the latter support the former in rigid interconnecting relationship. If the tube ends are all of the same diameter, only some of the baskets need be rigidly secured to the tube ends by an adhesive, with the other baskets interconnected thereto by connectors as described above.

8 Claims, 3 Drawing Figures

HEAT EXCHANGER WITH TUBE CLEANING ELEMENT CAPTURING CAGE INTERCONNECTION

U.S. PRIOR ART OF INTEREST

| U.S. Pat. No. | Inventor | Issue Date |
|---|---|---|
| 3,319,710 | Heeren et al | May 16, 1967 |
| 4,124,065 | Leitner et al | Nov. 7, 1978 |
| 4,353,414 | Leitner | Oct. 12, 1982 |
| 4,382,465 | Baron et al | May 10, 1983 |

BACKGROUND AND SUMMARY OF THE INVENTION

This invention relates to a heat exchanger with a tube cleaning element capturing cage interconnection.

It is known from some of the above-identified patents to connect individual elongated cleaning element capturing cages or baskets to both ends of longitudinally extending tubes disposed in a heat exchanger housing. The tube ends are held in position at both ends by transverse tube sheets. The baskets are adapted to contain shuttleable cleaning elements such as brushes. Fluid flowing in one direction through the tubes keeps the cleaning elements captured within their respective basket chambers, while the fluid discharges outwardly through slot-like openings in the basket walls. Upon reversal of fluid flow, the brushes are forced out of their baskets and through the tubes to the baskets at the opposite tube ends to thereby perform a tube cleaning action.

It is also known, as in Leitner U.S. Pat. No. 4,353,414, that when a rotatable pressure reversing distributor arm rotates between compartmentalized tube ends, bundles of baskets may be provided with interconnected lips which form an elongated contact surface which is registerable with the distributor arm. The baskets are shown as being press fit into the tube ends, such as in Baron et al U.S. Pat. No. 4,382,465.

When the baskets are press fit into the heat exchanger tubes, an adhesive such as an epoxy, has normally been utilized in the connection to rigidly secure the baskets to the tube ends. Considering that many hundreds of tubes and baskets may be needed for each installation, the extra step of applying the adhesive is time consuming and costly.

In addition, heretofore the tube ends throughout an exchanger have been of the same diameter so that the techniques for basket attachment would be the same for all tubes. Now, however, some heat exchangers have been constructed with tubes having varying diameter ends, creating substantial difficulties for attachment of baskets, all of which are basically the same size.

It is a task of the present invention to provide a construction which permits a labor-saving reduction in securing the baskets to the tube ends of a heat exchanger, regardless of whether the tube ends are of varying diameters or not.

In accordance with the various aspects of the invention, when the tube ends are of varying diameters, along the plane of a tube sheet, some baskets, which are slightly flexible, are press fit into the larger diameter tube ends and an adhesive used to rigidly secure the members together, as heretofore. In addition, other baskets are loosely slipped over the smaller diameter tube ends. However, an adhesive is not necessary to rigidly fix these latter baskets in place. Instead, a connector device joins baskets which are not rigidly fixed against axial movement to those that are, so that the latter support the former in rigid interconnecting relationship.

In the embodiment disclosed in the drawings the connectors extend laterally across the outer end portions of the basket chambers which confine the shuttleable cleaning elements. The connectors comprise elongated rods or the like which extend through stop devices mounted to the outer basket ends, said stop devices also functioning to retain the cleaning elements in their respective baskets.

If the tube ends are all of the same diameter, only some of the baskets need be rigidly secured to the tube ends by an adhesive, with the other baskets interconnected thereto by connectors as described above.

BRIEF DESCRIPTION OF THE DRAWINGS

The accompanying drawings illustrate the best mode presently contemplated by the inventor for carrying out the invention.

In the drawings

DESCRIPTION OF THE PREFERRED EMBODIMENT

Figure 1:
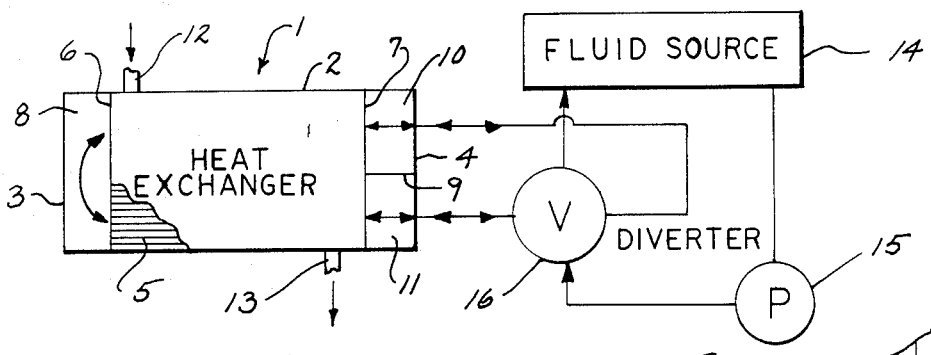
FIG. 1 is a schematic showing of a heat exchanger and fluid flow controls therefor.
Figure 2:
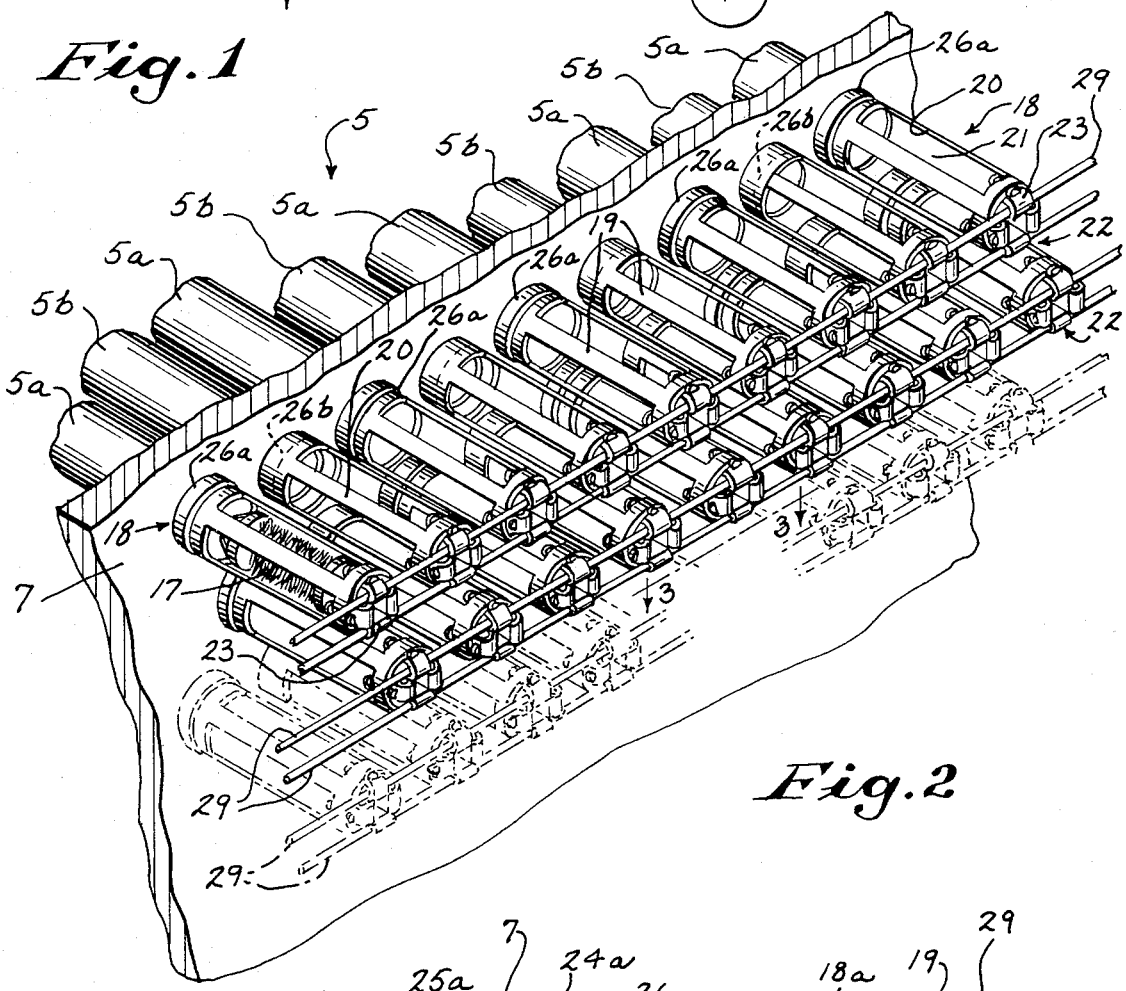
FIG. 2 is a fragmentary perspective showing of a plurality of capturing cages or baskets mounted to the heat exchanger tube ends adjacent a tube sheet.
Figure 3:
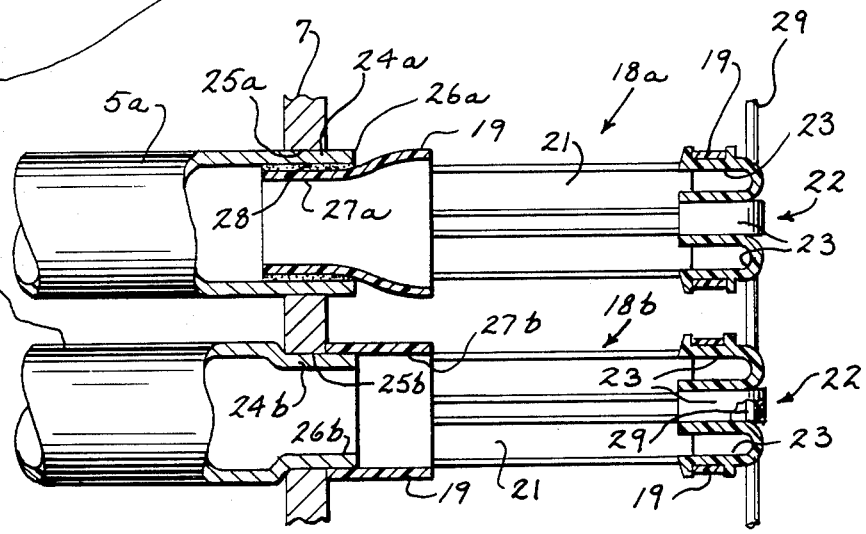
FIG. 3 is a horizontal section taken on line 3—3 of FIG. 2.

The present invention is directed to tube-type heat exchangers. A schematic showing of such an exchanger and its fluid flow controls is shown in FIG. 1. The exchanger 1 comprises a cylindrical housing 2 having end closure heads 3 and 4, and a plurality of longitudinally extending generally parallel cylindrical tubes 5 therein. The exposed open ends of tubes 5 are connected to transverse tube sheets 6 and 7 which are spaced from the respective end heads 3 and 4 and from each other. Tube sheets 6 and 7 may be formed of integral plates or a plurality of wedge-shaped segments. Head 3 and tube sheet 6 form one fluid flow chamber 8, while a partition 9 separates the space between head 4 and tube sheet 7 into a pair of fluid flow chambers 10 and 11. Heat exchanging fluid is introduced through an inlet 12 to the area around tubes 5 and discharges through an outlet 13.

Heat exchanger 1 is also connected to a fluid source 14, a pump 15 and a fluid diverter valve 16 by various conduits in the conventional manner. Fluid is directed through tubes 5 via chambers 10, 8 and 11, in that order or in reverse order, depending on the position of valve 16.

Heat exchanger 1 is provided with tube cleaning means. For this purpose, a shuttling brush 17 is disposed for moving back and forth through the respective tubes 5, the direction depending on the setting of valve 16. Brushes 17 are adapted to be held in position at the tube ends by separate capturing cages or baskets 18 which are mounted to be in fluid communication with the interiors of tubes 5. Baskets 18 are arrayed in rows and are formed of molded plastic or other suitable material and comprise an elongated longitudinal cylindrical wall 19 having fluid flow openings such as slots 20 therein, forming an internal brush-receiving chamber 21.

The outer end of each basket 18 is provided with a brush stop means which in this embodiment comprises a clip 22 having a plurality of looped legs 23 which snap onto wall 19 at the outer slot ends.

In the embodiment shown, fluid flow tubes 5 are provided with outer end portions of varying diameters. Thus, tubes 5*a* have outer end portions 24*a* which are of a larger O.D. than the outer end portions 24*b* of tubes 5*b*. For example, the O.D. of end portion 24*a* may be $\frac{3}{4}''$ while that of 24*b* may be $\frac{5}{8}''$. End portions 24*a* and 24*b* extend through suitable openings 25*a* and 25*b* in the respective tube sheet, 7 in this instance, and terminate outwardly of the tube sheet, forming annular extensions 26*a* and 26*b* into the respective heat exchanger fluid flow chamber. The varying diameter tube ends are shown as disposed in alternating sequence.

Baskets 18, which are adapted to be mounted to tube end portions 24*a* and 24*b*, could be formed with inner ends of varying diameters to accommodate a press fit connection within both sizes of tube end portions. However, this would require manufacturing a multiplicity of basket sizes. Instead, it is contemplated that the inner end portions 27*a* of baskets 18*a* be deformably press fit into extensions 26*a* of tube 5*a*, and an adhesive 28 be applied to the joint to rigidly secure baskets 18*a* in position and against axial movement, as in prior constructions. As for baskets 18*b*, their inner end portions 27*b* remain undeformed and loosely fit over tube extensions 26*b*.

To prevent axial shifting of the freely mounted baskets 18*b*, means are provided to connect baskets 18*b*, which are not rigidly connected to tubes 5*a*, to baskets 18*a* which are rigidly connected to tubes 5*b*. For this purpose, a pair of spaced generally parallel rods 29 extend through and between the looped legs 23 of stop clips 22 of each row of baskets, preferably from one side of heat exchanger housing 2 to the other. Rods 29 extend laterally across the outer ends of basket chambers 21 and are thus spaced apart a distance less than the diameter of basket walls 19.

Any tendency of a free basket 18*b* to move outwardly axially off its support 26*b* is prevented by rods 29, which are held firmly in place by the stop clips 22 on baskets 18*a* in the same row. No special adhesive is necessary to hold baskets 18*b* in place.

The concepts of the invention may also be utilized when the tube ends are of the same diameter, but wherein some of the baskets are not rigidly fixed against axial movement.

Various modes of carrying out the invention are contemplated as being within the scope of the following claims and particularly pointing out and distinctly claiming the subject matter which is regarded as the invention.

I claim:

1. In a heat exchanger, the combination comprising:

(a) a housing, (b) a plurality of fluid flow tubes disposed in general parallelism within said housing and with said tubes being arranged with exposed open ends adapted to communicate with a housing chamber, (c) a plurality of separate longitudinally extending baskets disposed in said chamber for capturing and holding shuttle type tube cleaning elements therein, (d) the inner end portions of some of said baskets being rigidly attached to the said ends of some of said tubes, and the inner end portions of others of said baskets being freely mounted to the said ends of others of said tubes, (e) and connector means connected to said rigidly attached baskets to hold said freely mounted baskets against outward axial movement.

2. The combination of claim 1 in which the ends of said some of said tubes are of a different diameter then the ends of said others of said tubes.

3. The combination of claim 2 in which:

(a) said rigidly attached baskets are press fit into said some of said tubes, (b) and said freely mounted baskets are loosely fit over the said others of said tubes.

4. The combination of claim 1 or 2 wherein:

(a) said baskets include internal chambers for receipt of said tube cleaning elements, (b) and said connector means extend laterally across the outer ends of said basket chambers.

5. The combination of claim 1 or 2:

(a) which includes stop means disposed at the outer ends of said baskets for retaining said tube cleaning elements within said baskets, (b) and wherein said connector means are connected to said stop means.

6. The combination of claim 5 wherein said stop means include looped portions through which said connector means extend.

7. The combination of claim 6 wherein said connector means comprises a plurality of spaced generally parallel connector elements extending through said looped portions and from one side of said housing to the other.

8. The combination of claim 1 or 2 wherein said rigidly attached baskets and said freely mounted baskets are disposed in alternating sequence.

* * * * *